US007086911B2

(12) United States Patent
Simmel

(10) Patent No.: US 7,086,911 B2
(45) Date of Patent: Aug. 8, 2006

(54) CONTACT WITH A RIGIDLY WELDED SPRING CAGE

(75) Inventor: Andreas Simmel, Schwaikheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/486,014

(22) PCT Filed: Feb. 18, 2003

(86) PCT No.: PCT/DE03/00485

§ 371 (c)(1),
(2), (4) Date: Sep. 13, 2004

(87) PCT Pub. No.: WO03/103099

PCT Pub. Date: Dec. 11, 2003

(65) Prior Publication Data

US 2005/0032441 A1 Feb. 10, 2005

(30) Foreign Application Priority Data

Jun. 4, 2002 (DE) ..... 102 24 683

(51) Int. Cl.
*H01R 4/48* (2006.01)

(52) U.S. Cl. ..... 439/839

(58) Field of Classification Search ..... 439/839, 439/851, 856, 857, 861, 862
See application file for complete search history.

(56) References Cited

U.S. PATENT DOCUMENTS

| | | | |
|---|---|---|---|
| 5,094,636 | A | 3/1992 | Zinn et al. |
| 5,338,229 | A | 8/1994 | Egenolf |

FOREIGN PATENT DOCUMENTS

| | | |
|---|---|---|
| DE | 37 25 688 | 2/1988 |
| DE | 88 09 677 | 1/1989 |
| DE | 101 16 187 | 10/2002 |
| EP | 0 727 842 | 8/1996 |

*Primary Examiner*—Khiem Nguyen
(74) *Attorney, Agent, or Firm*—Kenyon & Kenyon LLP

(57) ABSTRACT

A plug device having an electrical plug connector. Within the plug connector, quick-connect receptacles are situated in contact chambers, which make an electrical connection to mating connectors. In order to protect the quick-connect receptacles from possible failure due to excessively great vibration loads or other forces, it is provided that a spring basket be positioned in the region of the contact part of the quick-connect receptacle, which, besides form-locking connections, such as crimps, also has a force-locking connection to the remaining part of the quick-connect receptacle. This force locking connection is implemented by a welded connection, especially a laser weld pointing.

5 Claims, 2 Drawing Sheets

CONTACT WITH A RIGIDLY WELDED SPRING CAGE

FIELD OF THE INVENTION

The present invention relates to a plug device having an electrical plug connector which has a contact carrier made of an insulating material, which has at least one row of contact chambers closed off against each other and situated parallel to each other, in which, in each case, one quick-connect receptacle is situated which has a fastening section for the stripped end of an electrical line, a middle section, a contact section having a contact part and a waist-shaped section lying between the fastening section and the center section.

BACKGROUND INFORMATION

Many plug connectors of the above-mentioned species are known. They include a contact carrier and several parallel contact chambers arranged in series, so-called quick-connect receptacles being situated in the contact chambers. These quick-connect receptacles have several functional sections, namely a fastening section, to which a stripped cable or an electrical line may be attached by so-called crimping and connected electrically using a quick-connect receptacle, and a center section as well as a contact section, the contact section being provided to accommodate a pin, which is situated in a mating connector, so that an electrical connection may be brought about between the plug connector and the mating connector.

The quick-connect receptacle itself is positioned in a contact chamber within the plug connector in such a way that it is firmly held in this chamber, or fixed. It is known from the related art that, by bringing about a locking in the region of the waist-shaped section, one may bring about a fixing of the quick-connect receptacle within the chamber. In this context, the quick-connect receptacle is at a very small distance from the wall of the contact chamber.

For the firm fixing of the quick-connect receptacle within a contact chamber, other devices are also provided. For example, a locking slide is known from German Published Patent Application No. 37 25 688 which clamps the waist shape of the quick-connect receptacle inside the contact chamber.

The aforesaid locking mechanism assumes the task of directly absorbing or dissipating the forces appearing on the contact section during the plug-in process of the plug connector to the mating connector, so that almost no forces act on the fastening section or on the waist-like section. The decoupling of the vibration stress appearing during the application of the plug and the mating plug is performed inside the contact part by an elastic design, particularly by a suitable shaping of the middle section.

A disadvantage of the fixing and locking mechanisms known up to now is that unacceptably large forces appear particularly in the case of a clamping connection that is not completely executed, or in the case of a loose connection, especially between a spring element and a contact part, for example, coming about by shaking motions, which excessively stress individual elements, particularly the connection between the spring element and the contact part, but also the middle section, so that their function is not ensured.

A further disadvantage is that a spring element provided at the quick-connect receptacle releases a form locking that is provided between the two parts. This, in turn, leads to the elastic zone of the contact part being stretched too much, so that particularly powerful motions damage the contact point.

It is an object of the present invention to create a connection of a quick-connect receptacle to a mating connector within a contact chamber that is simple and protected from shaking movements.

The attainment of the object is that, at the quick-connect receptacle, on the side pointing to the mating connector, a buckle is positioned, which extends over a part of the contact part and is adjacent to it, the contact part and the buckle, besides the form locking connection having at least one force locking connection in the form of a welded connection.

SUMMARY OF THE INVENTION

According to the present invention, it is provided that one should slide onto an embodiment of a quick-connect receptacle known from the related art a so-called spring basket in the vicinity of the contact part and the middle section. This spring basket is predominantly a stamped part, which is then bent. The spring basket is clipped on owing to a corresponding fit, and is held to the quick-connect receptacle by so-called crimps. Additional bending processes lead to the spring basket's being connected in a form-locking way to the quick-connect receptacle.

Preferably, the spring basket extends exclusively in the contact region of the quick-connect receptacle. It is further conceivable that the spring basket may also extend all the way to the waist-shaped section. The spring basket itself also has cutting devices pointing towards the outside. These are used so that the spring basket can dig its claws in, into a contact chamber of a plug contact.

In order to compensate for the forces appearing during the process of clipping on or also the forces that are created especially in response to shaking movements by the plug connector and the mating connector, it is provided that one should connect the spring basket in a force locking manner, in addition to the form locking connection, as has been described. This force locking connection is achieved, for example, by a welded connection between the spring basket and the remaining part of the quick-connect receptacle.

Preferably it is provided that the connection shall be made with the aid of a laser weld point.

Preferably, the laser weld point is positioned in such a way that it is positioned in the region where the forces appear to a maximum. This is the region at which the spring basket ends, and at which the quick-connect receptacle has a waist-like form.

It has also proven advantageous that, because of the use of a laser for producing the weld point, different types of material, such as steel and copper, can be used.

By this inventive embodiment of a quick-connect receptacle together with a spring basket, it is achieved that failure of the plug connection will be avoided.

DETAILED DESCRIPTION

Figure 1:
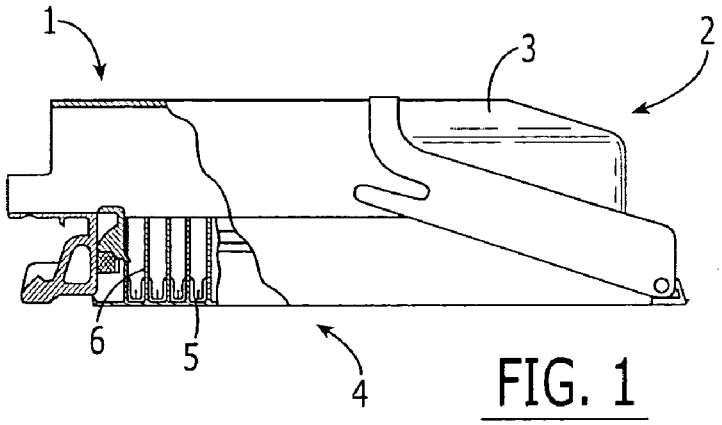
FIG. 1 shows a multipole electrical plug connector of a plug connection partially in longitudinal section.

Plug 1 shown in FIG. 1 has a plug housing 2 and a lid 3 harnessed together with plug housing 2. Plug housing 2 includes a contact carrier 4 which is subdivided into a plurality of contact chambers 5 that are parallel to one another and situated next to one another. Inside these contact chambers 5 quick-connect receptacles 6 are provided which are connected to a cable harness not shown in this drawing.

Figure 2:
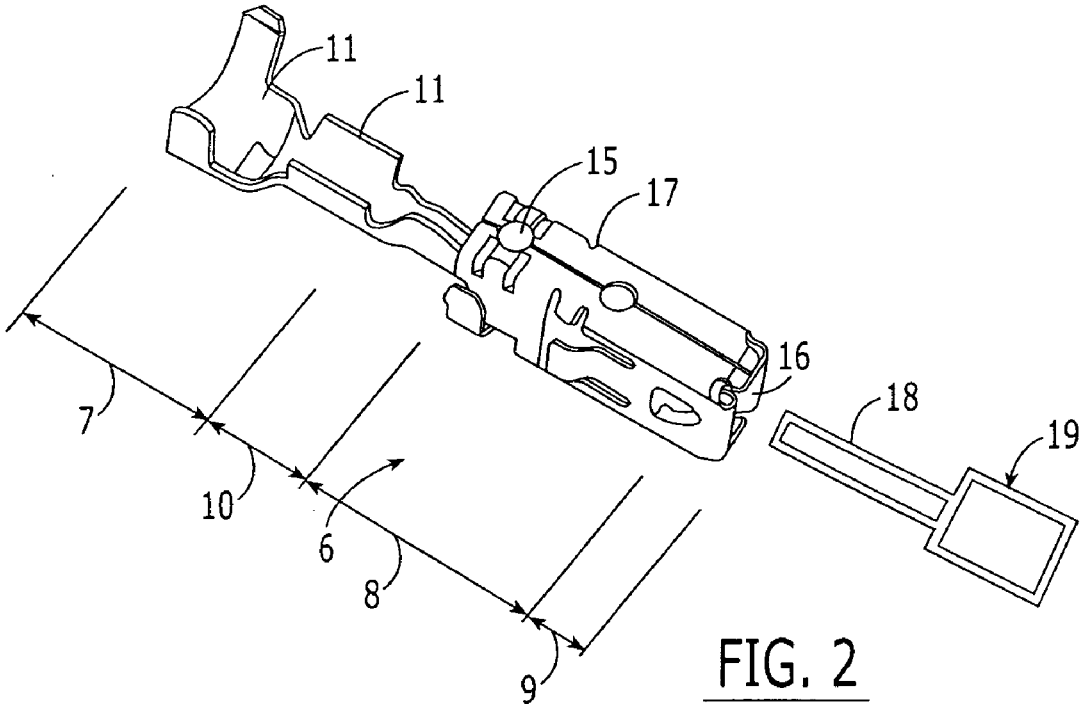
FIG. 2 shows a perspective view onto a quick-connect receptacle together with a spring basket.
Figure 3:
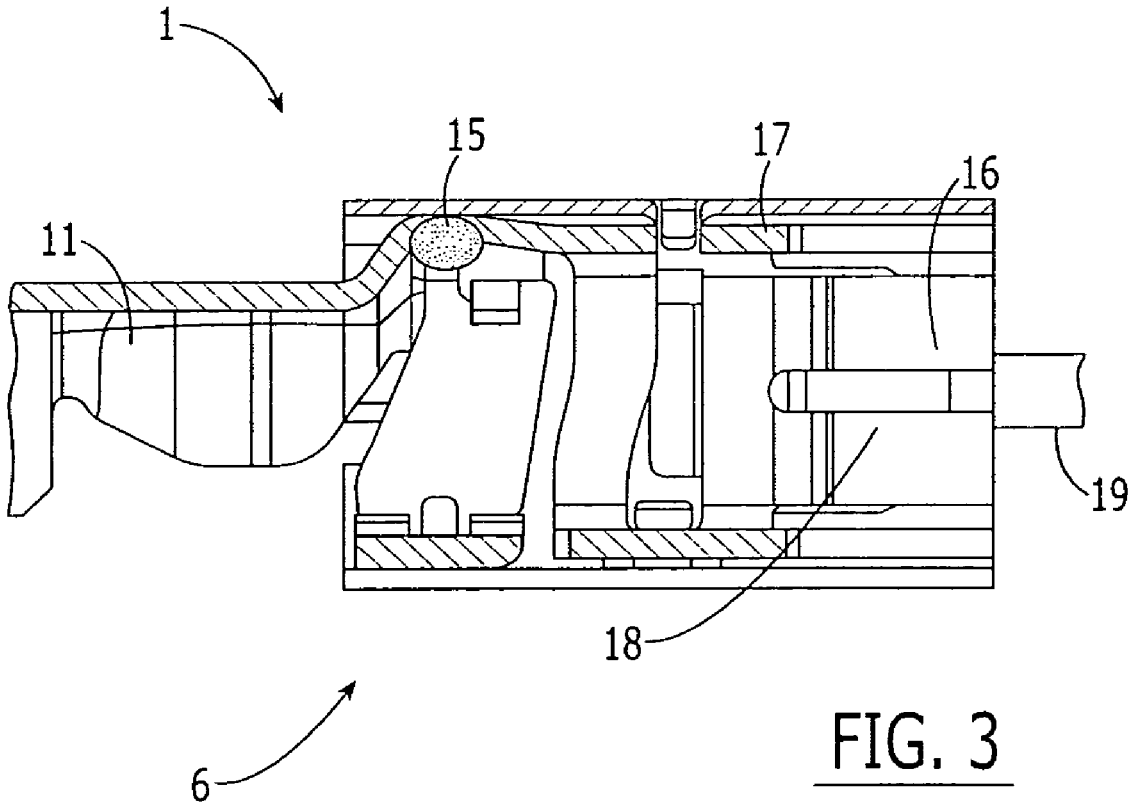
FIG. 3 shows a side view, partially a sectional representation of the quick-connect receptacle shown in FIG. 2.

FIG. 2 shows such a quick-connect receptacle, which is able to be positioned inside such a contact chamber 5. FIG. 3 shows a sectional representation of such a quick-connect receptacle 6 together with a spring basket 17 (also referred to as buckle 17).

Quick-connect receptacle 6 subdivides into several regions, namely a fastening section 7, a middle section 8 and a contact section 9 which has a contact part 16. In addition, between fastening section 7 and middle section 8, a waist-shaped section 10 is provided on the quick-connect receptacle.

The preferably meander-shape or wave-shape designed quick-connect receptacle 6 takes care in fastening section 7 that a stripped cable or an electric line is crimped between parts of fastening section 7 as well as clamping elements 11. In the region of waist-shaped section 10 the quick-connect receptacle runs waist-like, so that middle section 8 is designed to be approximately as wide as fastening section 7. Middle section 8 then runs over into contact section 9, which is embodied so that leaf spring arm contact elements are able to accommodate a pin 18 of mating connector 19, so that electrical contact between plug connector 1 and mating plug connector 19 is established.

Spring basket 17 produced by stamping is designed so that, in the assembled state, it can wrap at least around contact section 9 of quick-connect receptacle 6 and at specified sites (crimps) engages in a form locking connection with the quick-connect receptacle. This means that, to mount spring basket 17 on contact part 16 of contact section 9, spring basket 17 is simply slid on until the corresponding crimps engage in a connection among one another.

According to the present invention it is provided that, in addition to this form-locking connection, a force-locking connection can also be produced, in that particularly on the flat side of spring basket 17, in the region of contact part 16, a laser weld point (welding connection 15) is placed in such a way that a force locking connection between spring basket 17 and the remaining part of quick-connect receptacle 6 is produced.

Thereby it is possible that appearing vibrational loads, that act upon the quick-connect receptacle, act directly by the force locking connection upon spring basket 17, and thus save the remaining part of quick-connect receptacle 6 from possible failure.

What is claimed is:

1. An electrical plug connector, comprising:

a quick-connect receptacle;

a contact carrier made of an insulating material and including at least one row of contact chambers closed off against one another and situated parallel to one another, in each of which the quick-connect receptacle is positioned;

a fastening section for a stripped end of an electric line;

a middle section;

a contact section including a contact part;

a waist-like section lying between the fastening section and the middle section;

a buckle situated on the quick-connect receptacle on a side pointing to a mating plug, the buckle extending over a part of the contact part and located adjacent to the contact part, wherein:

the contact part and the buckle have a form locking connection and have at least one force connection in the form of a welded connection.

2. The electrical plug connector as recited in claim 1, wherein:

the buckle is situated in a region of the contact section.

3. The electrical plug connector as recited in claim 1, wherein:

the buckle is situated at least in a region of the fastening section.

4. The electrical plug connector as recited in claim 1, wherein:

the welded connection is implementable using laser weld pointing.

5. The electrical plug connector as recited in claim 1, wherein:

the welded connection is situated directly in a region of a transition from the middle section into the waist-like section.

* * * * *